US005857604A

United States Patent [19]

Warren

[11] Patent Number: 5,857,604

[45] Date of Patent: Jan. 12, 1999

[54] DEVICE AND METHOD FOR OPENING WRAPPED ROLL OF COINS

[76] Inventor: James L. Warren, 2314 N. Dorothy Ave., White Bear Lake, Minn. 55110

[21] Appl. No.: 929,124

[22] Filed: Sep. 3, 1997

[51] Int. Cl.[6] ..... B26F 3/02

[52] U.S. Cl. ..... 225/93; 30/169

[58] Field of Search ..... 225/1, 93, 103; 30/2, DIG. 3, 169

[56] References Cited

U.S. PATENT DOCUMENTS 4,757,611 7/1988 Tommi et al. ..... 30/2
4,825,738 5/1989 Jones ..... 30/2 X
5,123,320 6/1992 Hochfeld ..... 30/2 X
5,456,060 10/1995 Tipp ..... 30/2 X

*Primary Examiner*—Rinaldi I. Rada
*Assistant Examiner*—T. Anthony Vaughn
*Attorney, Agent, or Firm*—Jacobson and Johnson

[57] ABSTRACT

A device which can be held in the fingers of one hand has a thin front edge and an underside curved surface which conforms generally to the contour of a wrapped roll of coins and when the roll is held by one hand, the device is held in the other hand and the front edge slipped under an exposed edge of the roll wrapping and then advanced or moved by either rotating the roll of coins or moving the device under the wrapping to separate the wrapping from the roll of coins to expose the coins.

3 Claims, 2 Drawing Sheets

DEVICE AND METHOD FOR OPENING WRAPPED ROLL OF COINS

FIELD OF THE INVENTION

This invention is directed toward a device for opening a wrapped roll of coins by peeling away the wrapper.

DESCRIPTION OF THE PRIOR ART

Wrapped rolls of coins are used extensively by patrons of casinos and by bank tellers and cashiers at retail establishments and restaurants. To remove the coins from the wrapping the user oftentimes merely bangs the roll against some nearby object to break the wrapping which then either allows the roll to be further unwrapped or allows the coins to fall into a depository. It is not uncommon that the user injures his or her fingers or hand. Another problem that has arisen recently is in the case of retail establishments and restaurants which use electronic type registers. The banging of a roll of coins against the register may cause damage to the sophisticated equipment that is part of the modern day register or may cause an error in the operation of the device.

There have been various devices made to open wrapped rolls of coins. U.S. Pat. No. 4,038,746 by Bromley utilizes a key-like device which apparently tears off or cuts off the rolled rim or ridge at the end of the roll of coins. Bromley has a pair of prongs, one which extends lengthwise along the outside of the roll and another shorter inner prong, which cut and then twist to remove the rim of the wrapping. Another device is shown in U.S. Pat. No. 4,757,611 by Tommi, et al. which can be held in a single hand and has a sharp pointed cutter and has a knife or a blade which can be swung into position to cut the wrapping. Another device for opening wrapped rolls of coins is shown in U.S. Pat. No. 5,086,962 which has a device with an anvil on a base and the roll of coins is struck against the anvil to break it open. The two former prior art devices utilizing sharp cutting edges can be somewhat dangerous and the latter device of course is nothing more than providing a convenient place to bang the roll of coins on instead of against a cash register or nearby slot machine or the like.

SUMMARY OF THE INVENTION

A device which can be easily held in the fingers of one hand has a front or forward thin but not knife-sharp edge and a curved or arcuate surface on its underside extending rearward from the front edge. The curvature of this surface is selected so that it conforms generally to the contour of the wrapped roll of coins and the thin edge is such that it will conveniently slip under an exposed edge of the wrapping. The front edge is advanced under the wrapping to separate the wrapping from the roll of coins by either rotating the roll of coins or by holding the coins still and moving the device or preferably a combination of the two. In any event, the wrapping is then easily separated from the roll of coints and the process is continued until it is totally removed or the user can then conveniently tear away some or the rest of the wrapping. Preferably the top surface of the device rearward from the front end has a depression to accommodate the user's thumb. On the underside surface rearward from the end of the curved surface is a pair of depressions, one for accommodating the user's forefinger and the other for accommodating the middle finger, so that the device rests comfortably in the user's hand with the roll of coins held in the other hand. As yet another feature, the thumb recession or depression may be roughened somewhat so that the thumb stays in place and doesn't slip as it is used to apply pressure to separate the wrapping from the roll of coins.

DESCRIPTION OF THE PREFERRED EMBODIMENTS

Figure 1:
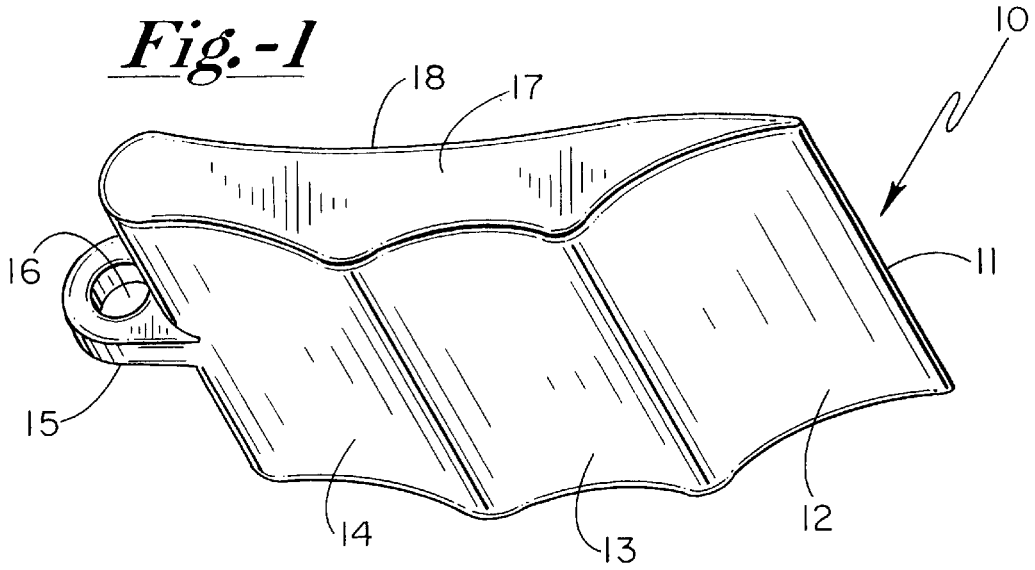
FIG. 1 is a perspective view of a preferred embodiment of the invention.
Figure 2:
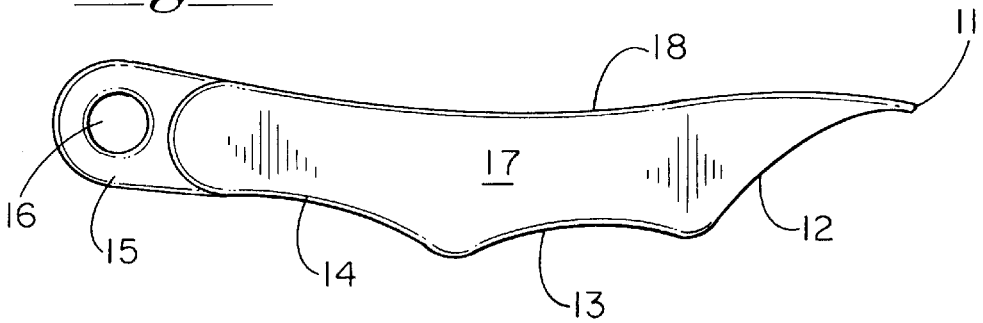
FIG. 2 is a side elevational view.
Figure 3:
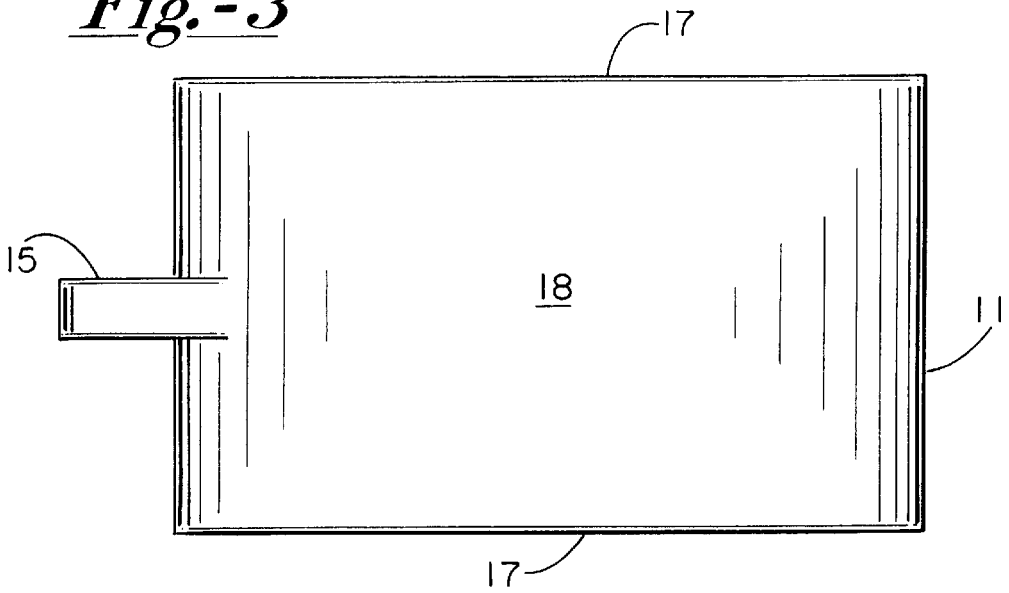
FIG. 3 is a top view.

Preferably the device 10 for unwrapping a roll of coins is a solid molded lightweight plastic piece. While for the most part, and unless otherwise stated, the dimensions are not critical. However, the device should be lightweight, small enough to fit in the user's hand and stored away conveniently in a pocket yet not be so tiny that it is easy to lose or even difficult to hold and manipulate.

Body 10 has a thin but not sharp leading edge 11 and a curved underside surface 12 extending rearward from edge 11. The lower surface of device 10 also contains a pair of adjacent depressed areas or recesses 13 and 14 and extending outward from the back end may be a hub 15 with a opening 16 for receiving a chain or string as a convenient way of preventing the device from being lost. The two parallel sides 17 are preferably flat and unadorned to provide a convenient space for adding designs or advertisement or information or data, not shown. At about the midcenter of the top surface of body 10 is a recessed area 18. The ends and the sides and comers are all rounded off so that there are no sharp cutting edges.

Figure 4:
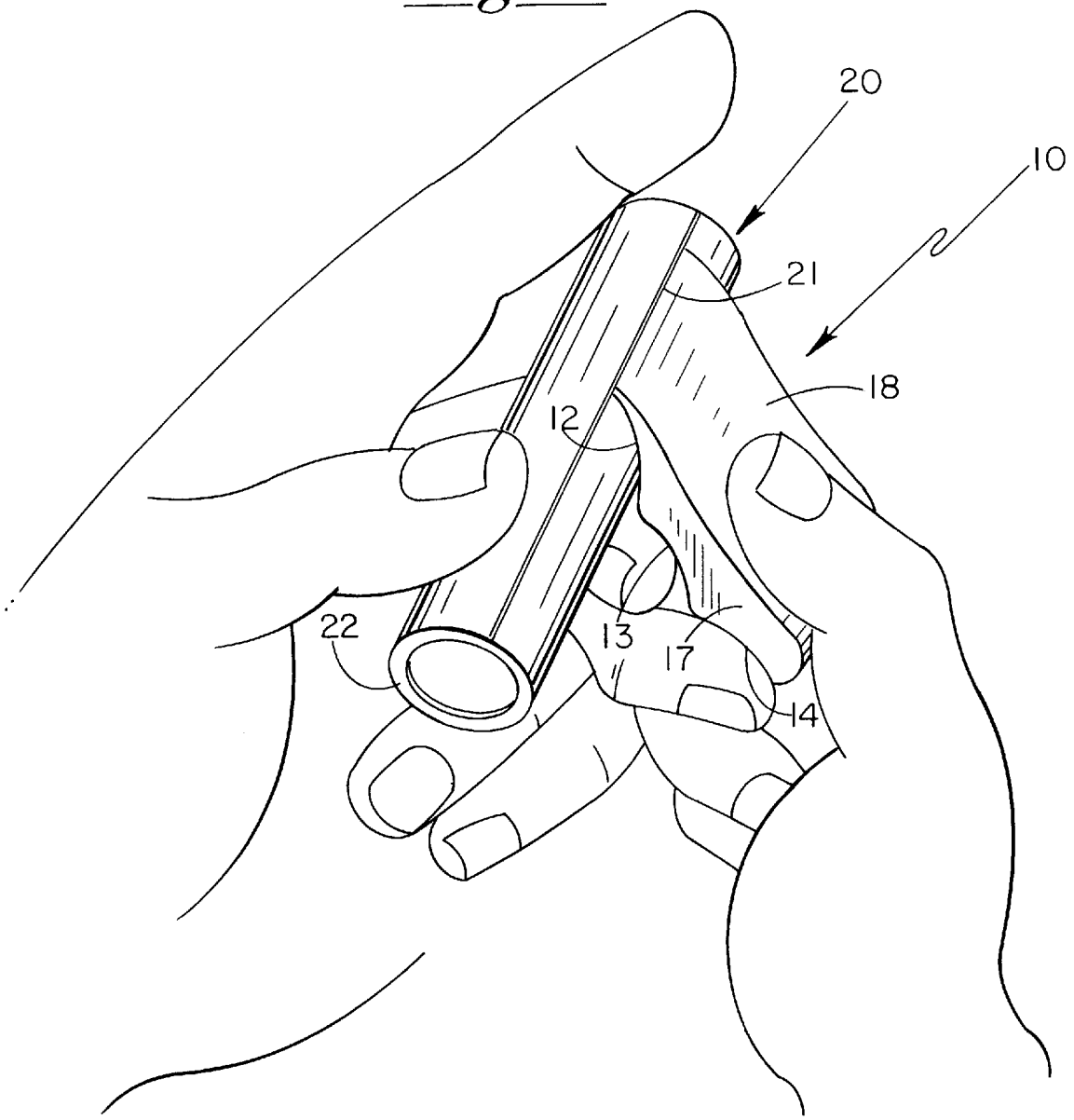
FIG. 4 is a perspective view illustrating the manner of using the preferred form of the invention.

As illustrated in FIG. 4, in use body 10 is held in one hand and a wrapped roll of coins 20 is held in the other hand. Preferably the thumb of the one hand is placed in recessed area 18 facing generally toward the front edge 10 or toward the roll of coins 20 and the forefinger is placed in recess 13 and the middle finger placed in recess 14. The device is then moved with respect to the wrapped roll of coins so that front edge 11 is slipped or pushed under an exposed terminal edge 21 of the wrapping over the roll of coins. The curved surface 12 generally rests on or is located very close to the outer contour of the roll of coins and edge 11 is advanced under the wrapping to separate or tear away the wrapping from the roll. This can be done either by holding the roll of coins still and moving body 10 or rotating the roll of coins while holding the device 10 still or by a combination of the two.

Generally the wrapped roll of coins has a raised rim or ridge 22 at each end formed by a rollover of the edge of the wrapping. Preferably body 10 is placed so that a side edge of front edge 11 is closely adjacent the end of the roll of coins 20 so that the rolled rim or ridge 22 at that end is torn away from the wrapping as the edge 11 advances under the wrapping and tears the wrapping away from the roll of coins.

As mentioned earlier while the dimensions in general are not critical, it has been found that to best accommodate the variation in the rolls of coins ranging from the small diameter dimes up to the large silver dollar pieces that the radius of curvature of surface 12 should be in the range of about 0.59 inches and the length of the arc or surface 12 from the edge 11 should be in the order of about 0.54 inches. It has been found with these dimensions that the surface 12 will conform generally close to the contour of the wide variety of wrapped rolls of coins to function in the manner and fashion described hereinabove efficiently and reliably.

As an added feature, the thumb-holding area 18 can be roughened so that in use the thumb will have a better grip on body 10.

I claim:

1. A hand-held device for opening a wrapped roll of coins having an exposed edge and a turned over rim at an end of the roll, said device comprising:

a rigid body suitable for holding by the fingers of one hand, said body having a front thin edge for slipping under an exposed edge of the wrapping, an upper surface and an underside surface extending rearward from said front edge, said underside surface having a curvature conforming generally to the outer contour of the roll of coins for resting against the roll of coins while said front edge advances under the wrapping to separate the wrapping from the roll of coins.

2. The device for opening a wrapped roll of coins as described in claim 1 wherein said body has two generally parallel sides and a depression on its upper surface rearward of the front edge for receiving a user's thumb.

3. The device for opening a wrapped roll of coins as described in claim 2 wherein said body has a pair of depressions on its underside surface rearward of said curvature for receiving a user's forefinger and middle finger.

* * * * *